United States Patent [19]

Erbstoesser et al.

[11] 4,421,167

[45] Dec. 20, 1983

[54] METHOD OF CONTROLLING DISPLACEMENT OF PROPPING AGENT IN FRACTURING TREATMENTS

[75] Inventors: Steven R. Erbstoesser, Missouri City; Robert L. Graham, Houston, both of Tex.

[73] Assignee: Exxon Production Research Co., Houston, Tex.

[21] Appl. No.: 412,671

[22] Filed: Aug. 30, 1982

Related U.S. Application Data

[63] Continuation of Ser. No. 204,103, Nov. 5, 1980, abandoned.

[51] Int. Cl.[3] ..... E21B 33/13; E21B 43/267; E21B 47/06

[52] U.S. Cl. ..... 166/255; 166/281; 166/284

[58] Field of Search ..... 166/299, 259, 271, 280, 166/281, 284, 308

[56] References Cited

U.S. PATENT DOCUMENTS

| | | | |
|---|---|---|---|
| 2,699,212 | 1/1965 | Dismukes | 166/280 |
| 2,754,910 | 7/1956 | Derrick et al. | 166/284 |
| 3,028,914 | 4/1962 | Flickinger | 166/284 |
| 3,174,546 | 3/1965 | Flickinger | 166/308 |
| 3,384,176 | 5/1968 | Huitt | 166/308 |
| 3,482,633 | 12/1969 | Stipp et al. | 166/284 |
| 4,102,401 | 7/1978 | Erbstoesser | 166/284 |
| 4,139,060 | 2/1979 | Muecke et al. | 166/281 |
| 4,194,566 | 3/1980 | Maly | 166/308 X |
| 4,195,690 | 4/1980 | Erbstoesser et al. | 166/284 X |

FOREIGN PATENT DOCUMENTS

| | | | |
|---|---|---|---|
| 147156 | 10/1962 | U.S.S.R. | 166/308 |

OTHER PUBLICATIONS

Webster et al., "A Continuous Multistage Fracturing Technique", *Journal of Petroleum Technology*, Jun. 1965, pp. 619–625.

Coburn, "Unlimited-Limited Entry", *The Oil and Gas Journal*, vol. 61, No. 10, Mar. 11, 1963, pp. 88–92.

*Primary Examiner*—George A. Suchfield

*Attorney, Agent, or Firm*—Richard F. Phillips

[57] ABSTRACT

A method of preventing overdisplacement of propping agent particles during well treatments to hydraulically induce a fracture in a subterranean formation wherein buoyant or neutrally buoyant ball sealers are incorporated in the trailing end portion of the fracturing fluid. The ball sealers seat on at least some of the well perforations in final stages of particle injection thereby causing the surface pumping pressure to increase, signalling the end of the treating operation. This minimizes proppant overdisplacement and provides for a fully packed fracture in the near wellbore region.

6 Claims, 2 Drawing Figures

METHOD OF CONTROLLING DISPLACEMENT OF PROPPING AGENT IN FRACTURING TREATMENTS

CROSS REFERENCE TO RELATED APPLICATIONS

This application is a continuation of U.S. patent application Ser. No. 204,103, filed Nov. 5, 1980, now abandoned.

BACKGROUND OF THE INVENTION

1. Field of the Invention

This invention relates to the treatment of oil wells, gas wells, injection wells and similar boreholes. In one aspect it relates to a method of stimulating the productivity of hydrocarbon-bearing formations by hydraulic fracturing techniques. In a more specific aspect, it relates to a method of preventing the overdisplacement of propping agent particles into a subterranean formation during the hydraulic fracturing treatment.

2. Description of the Prior Art

A common technique for stimulating the productivity or injectivity of subterranean formations is a treatment known as hydraulic fracturing. In this treatment, a fluid is injected down the well and into the formation at a high pressure and rate to cause the formation to fail in tension, thereby creating a crack (fracture) in the formation. The earth stresses are normally such that the fracture is vertical, extending in opposite directions from the well. The fracture can be extended several hundred feet into the formation depending upon the volume and properties of treating fluid. The fracture is normally propped open by means of particles known as propping agents. The propping agent is carried down the well and into the formation as a suspension in the fracturing fluid. As the fracturing fluid bleeds off into the formation, the propping agent is deposited in the fracture. Upon the release of the fluid pressure, the fracture walls close upon the propping agent. The propping agent thus prevents the fracture from completely closing, thereby creating a highly conductive channel in the formation. If properly performed, the hydraulic fracturing treatment can increase productivity of a well several fold.

A problem associated with the placement of the propping agent in a fracture is that of overdisplacement. As pointed out in SPE Paper 3030 "Stresses and Displacements Around Hydraulic Fractured Wells" published by the Society of Petroleum Engineers of the AIME in 1970, the closure stress of a fracture at the mouth in the near wellbore region can affect productivity. If the fracture is not completely filled with propping agent in the near wellbore region, the productivity will be greatly reduced. Studies have shown that the stress level in this region causes the fracture to close upon incomplete fracture fill-up, thereby reducing the effectiveness of the treatment.

On the other hand, if too large a volume of propping agent is used, the process will settle in the wellbore and could cover the well perforations and reduce well productivity.

The normal technique for preventing overdisplacement of the slurry (propping agent particles suspended in the fracturing fluid) is to carefully monitor the volume of fluid pumped into the well so that upon injection of the proper volume of displacement fluid, the pumping operations are terminated. The proper displacement volume is based upon tubular volume calculations.

However, the instruments, including flowmeters, tank strapping techniques, etc., used to measure the total volume of displacement fluid are not precise. Because of the inherent inaccuracies in these instruments, the monitoring technique frequently results in underdisplacement or overdisplacement of propping agent into the fractures.

SUMMARY OF THE INVENTION

The present invention provides for a simple technique which positively prevents the overdisplacement or underdisplacement of propping agent. It has been discovered that by incorporating ball sealers of controlled density in a trailing end portion of a fluid carrying the propping agent to the fracture, the ball sealers upon reaching the perforated interval will seat on and close the perforations thereby preventing overdisplacement. In a preferred embodiment, wherein a displacement fluid is used to flush the fracturing fluid through the well tubulars, ball sealers are selected to have a density less than or equal to that of the fracturing fluid but greater than that of the displacing fluid. In another embodiment, wherein the same fracturing fluid is used as the displacing fluid, the ball sealers are selected to have a density less than that of the slurry but greater than that of the fracturing fluid. During transport in the first embodiment the ball sealers will be maintained at the interface (or transition region) between the fracturing fluid and the displacement fluid. If the fracturing fluid and the displacement fluid are the same, the ball sealers will be maintained at the slurry/displacement fluid transition region.

DESCRIPTION OF THE PREFERRED EMBODIMENT

Figure 1:
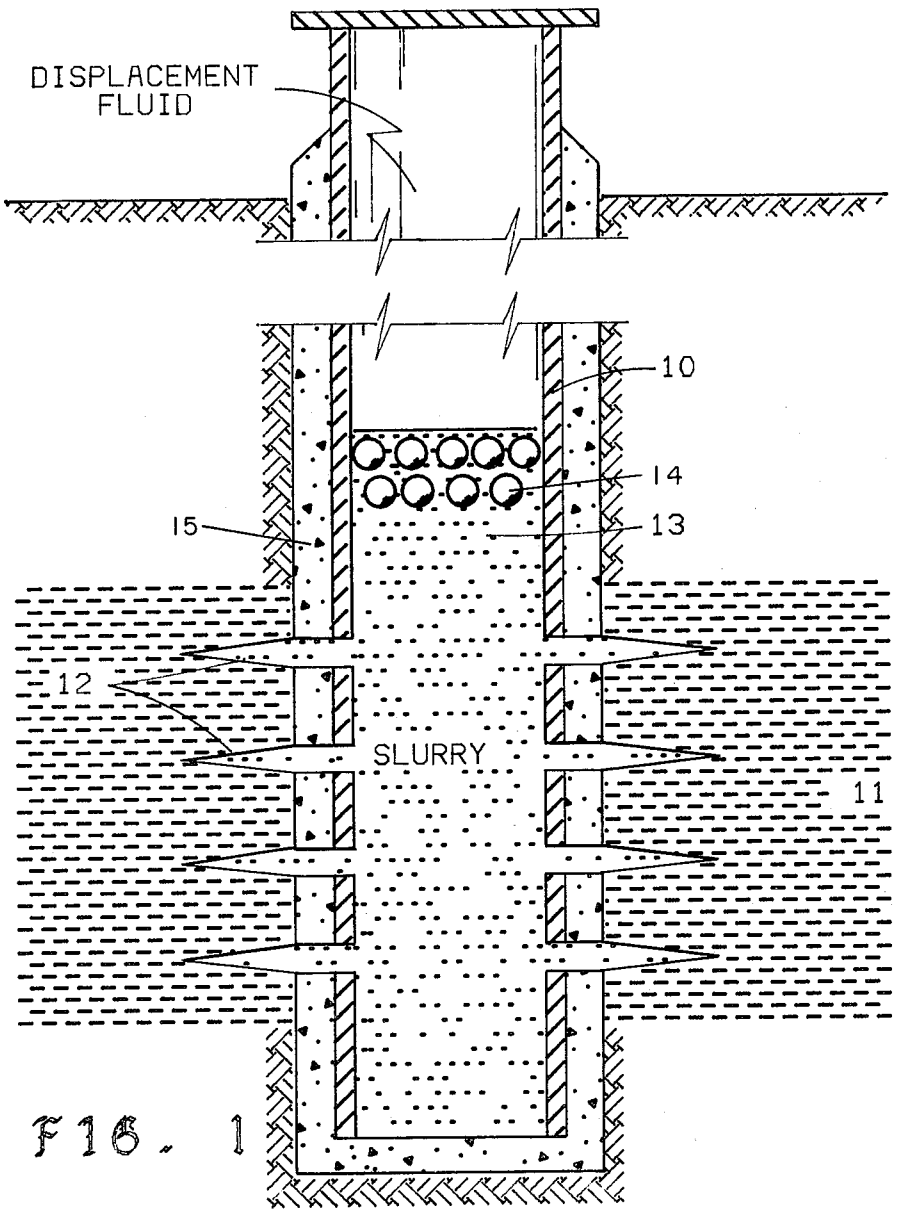
FIG. 1 is a schematic showing the relative position of the ball sealers at the transition region between a fracturing fluid and the displacement fluid during transport down the well tubulars.

The present invention is specifically adapted for use in hydraulic fracturing of oil wells, gas wells or water wells. With reference to FIG. 1, such wells are normally provided with casing 10 which extends from the surface through a hydrocarbon-bearing formation 11. The casing, cemented in place, is provided with a plurality of perforations 12 which penetrate the casing 10 and the cement sheath 15 surrounding the casing. The perforations provide flow paths for fluids to flow into the casing 10.

In order to stimulate the productivity of the well, the formation 11 is frequently fractured. This is accomplished by injecting a fracturing fluid down the casing 10 through the perforations 12 and into the formation 11. (In fracturing operations, the fluid is usually injected through a tubular string positioned inside the casing. For purposes of describing this invention, however, it is not necessary to illustrate the tubing.) The injection is conducted at such a rate and pressure to cause the formation to fracture forming radially outwardly extending fractures. Once the fracture is initiated, a carrier fluid is used to transport propping agent particles such as sand, glass beads, or ceramic proppants into the fracture. The terms "fracturing fluid" and "carrier fluid" are used interchangeably herein. The propping agent particles are illustrated as dots 13 in the drawing. The slurry of carrier fluid and propping agent is flushed down the casing (or the tubing, if used) and into the perforations 12 by means of a displacement fluid. As mentioned previously, it is important to avoid overdisplacement of the propping agent deeply into the fracture and away from the near wellbore region.

In accordance with this invention, ball sealers illustrated as 14 are incorporated in the trailing portion of the carrier fluid. The density of the balls is controlled to prevent settling in the carrier fluid or slurry. Ball sealers have long been used as diverting agents, but have not been used to prevent overdisplacement of propping agent particles in the manner described herein. Ball sealers are generally spherical having a diameter ranging from about $\frac{5}{8}$ inches (1.59 cm) to about $1\frac{1}{8}$ inches (2.86 cm). They may be composed of resinous material such as nylon or syntactic foam and may have deformable covers of plastic or elastomer to aid in the sealing of perforations. The density of ball sealers normally range from about 0.8 to about 1.9 g/cm$^3$. A particularly suitable ball sealer for use in the present invention is a rubber-coated syntactic foam ball sealer described in U.S. Pat. No. 4,102,401.

The ball sealers for a particular application will depend upon the fluid system used in the treatment. The density of the ball sealers is selected to prevent settling in the slurry. In treatments using a displacing fluid lighter than the fracturing fluid, the sealers may have a density less than or equal to the fracturing fluid but greater than the displacing fluid. In treatments wherein the densities of the fracturing fluid and displacing fluid are about the same, the density of the ball sealers should be less or equal to that of the slurry but greater than that of the fracturing fluid.

The fracturing fluid may be any of those presently used including water-based, oil-based, and emulsion fluids having densities between 6.5 pounds per gallon (777.9 gm/l) and 10.0 pounds per gallon (1197 gm/l). The displacement fluid frequently is a gas or a hydrocarbon liquid such as diesel or lease crude to facilitate establishing initial production following treatment. However, water or the fracturing fluid itself may also be used as the displacing fluid.

Any propping agent may be used. Sand is by far the most common, but glass beads, resin particles, and ceramic proppants are frequently used proppants. The particle size normally ranges from 10 mesh to 80 mesh with 20–40 mesh being the most common. The concentration of the particles in the carrier fluid also may vary within a relatively broad range. For a normal fracturing treatment the overall average of "sand" concentration is usually between 1 to 3 pounds per gallon (119.7 to 359 gm/l); however during the treatment sand concentration is often in the 3 to 5 pounds per gallon (359 to 598.4 gm/l) range, and at times it is 6 pounds per gallon (718.1 gm/l) and above.

The following laboratory test demonstrates that ball sealers heavier than a fluid will exhibit buoyancy in a sand suspension of that fluid.

A 4-foot (121.9 cm) section of 2-inch (5.1 cm) lucite tube closed at one end was filled with water having a density of 8.3 pounds per gallon (993.4 gm/l) and 20–40 mesh sand was added to provide a concentration equivalent to 8.7 pounds per gallon (1041.2 gm/l). Syntactic foam-cored and nylon-cored ball sealers, having densities of 1.0 and 1.1 g/cm$^3$, respectively, were then introduced into the tube. The top of the tube was closed. The tube was agitated to disperse the sand and the ball sealers. When the agitation was stopped the balls tended to rise to the top of the slurry where the ball sealers remained in the upper portion of the slurry as the sand settled within the tube.

Figure 2:
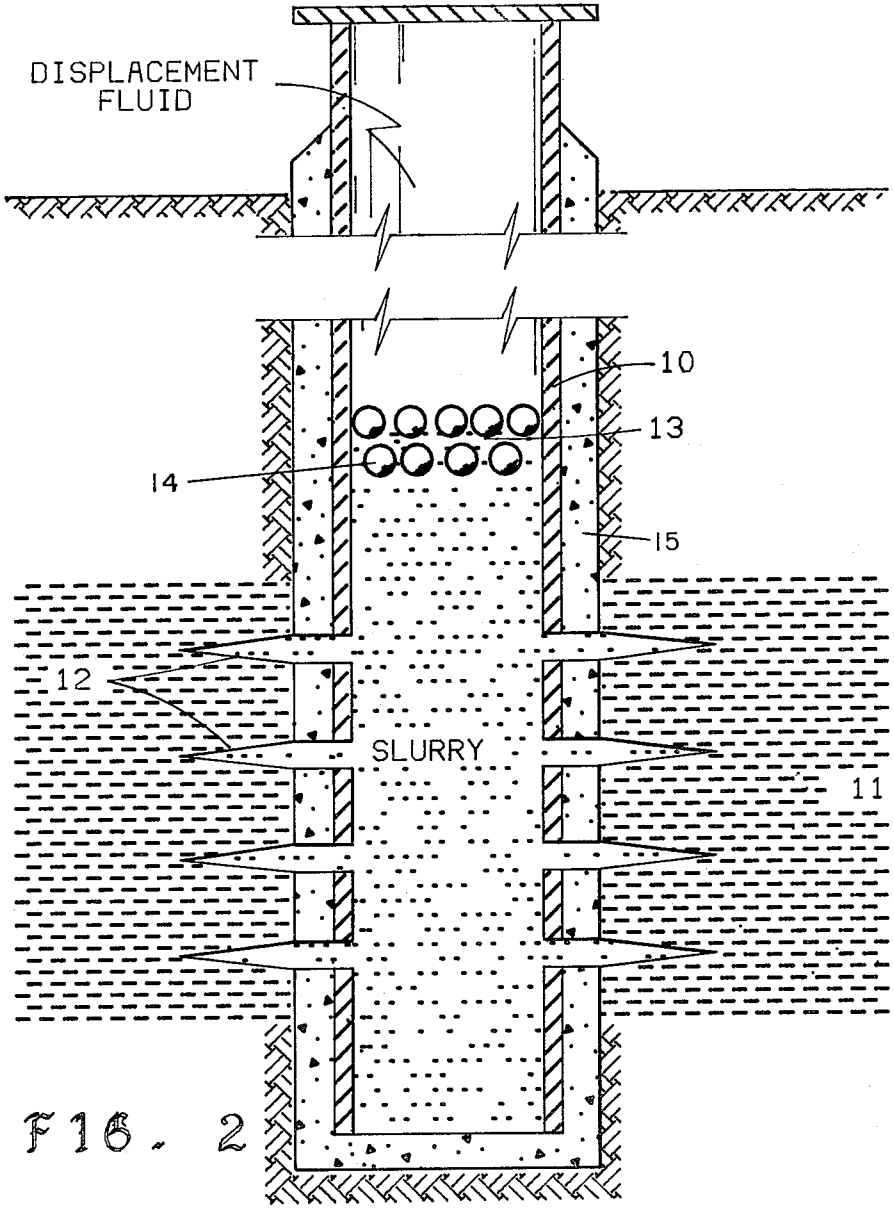
FIG. 2 is a schematic similar to FIG. 1 showing the ball sealers being transported at the transition region between a slurry and displacement fluid.

In carrying out the treatment according to the present invention, the fracturing operation may be performed in the conventional manner employing the desired amounts of fracturing fluid and proppant. Normally a pad volume is used to initiate the fracture and the carrier fluid is used to transport the propping agent into the fracture. During the final stages of blending in the propping agent into the slurry at the surface, a plurality of ball sealers (usually in excess of the number of perforations of the wells) are incorporated in batch form into the slurry along with the propping agent or immediately following the propping agent. If a displacing fluid is used, it normally will have a density equal to or less than that of the fracturing fluid. If the density is less, the ball sealers will be selected to have a density intermediate that of the fracturing fluid and displacement fluid. The ball sealers will thus tend to collect at the interface or transition region as shown in FIG. 1. If the density of the fracturing equal to that of the displacing fluid or if the fracturing fluid itself is used as the displacing fluid, as shown in FIG. 2, the ball sealers will be selected to have a density slightly greater than that of the fracturing fluid. As demonstrated in the laboratory experiment described above, these ball sealers will not settle in the slurry but will remain in the trailing end portion thereof.

Injectors are available for placing the ball sealers in the stream at the proper time. Ideally, the ball sealers may be positioned in a by-pass type injection line which may be activated at the proper time by directing the flow through the injector line, causing all of the balls to the introduced into the well at once.

During transport down the well, the ball sealers will remain in the trailing fluid portion of the treating fluid. As the trailing fluid portion of the carrier fluid approaches the perforations, the ball sealers will seat on the perforations closing off the flow therethrough. Since the balls by design are to remain in the trailing fluid portion, the sealing will occur before the displacement fluid can overdisplace the propping agent. As more and more balls seat on the perforations, monitoring of the surface pumping pressure will indicate a pumping pressure increase, signaling that termination of the pumping of the treating fluid and other aspects of the treating operation should be made. Ideally, all of the perforations will be sealed because an excess number of the balls is used. However, because some of the perforations may not be receiving fluid, it is possible that a small number of the perforations may not be sealed. This, however, should be of no consequence because over displacement would not be a problem in these perforations.

As can be seen by the foregoing description, the invention provides a simple but positive method for preventing the overdisplacement or underdisplacement of propping agent. While an embodiment and application of this invention has been shown and described, it will be apparent to those skilled in the art that many more modifications are possible without departing from the inventive concepts herein described. The invention, therefore, is not to be restricted except as is necessary by the prior art and by the spirit of the appended claims.

What is claimed is:

1. A method for preventing the over-displacement of propping agent in a hydraulically-induced fracture in a subterranean formation surrounding a well casing having a perforated interval therein, which comprises incorporating ball sealers in the trailing portion of a slurry of propping agent particles and fracturing fluid being injected down the well and into the formation; displacing the fracturing fluid having the ball sealers suspended therein to the perforated interval with a displacing fluid having a density equal to or less than the fracturing fluid, said ball sealers having a density greater than that of the displacing fluid but sufficiently low to prevent settling in the slurry; monitoring the surface pumping pressure during pumping of the displacing fluid; and, terminating said displacement of the fracturing fluid in response to detection of an increase in the surface pumping pressure.

2. A method as defined in claim 1 wherein the ball sealers have a density greater than that of the fracturing fluid but less than that of the suspension of propping agent particles in fracturing fluid.

3. A method as defined in claim 1 wherein the number of ball sealers exceeds the number of perforations in the casing.

4. A method as defined in claim 1 wherein the fracturing fluid is a liquid having a density between about 6.5 and 10.0 pounds per gallon (777.9 and 1197 gm/l respectively) and the propping agent particles have a size between about 10 and 80 mesh on the U.S. Sieve Series and are present in the fracturing fluid in a concentration of between about 1 and 6 pounds per gallon (119.7 and 718.1 gm/l respectively).

5. The method as set forth in claim 1 further comprising the step of terminating all surface pumping operations in response to detection of an increase in the surface pumping pressure.

6. A method for controlling the displacement of propping agent in the fracturing treatment of a cased well, said cased well having an interval with a plurality of perforations therethrough, said method comprising the steps of:

pumping into the well a carrier fluid bearing a propping agent, said mixture of carrier fluid and propping agent being of a first density;

incorporating ball sealers at a point in the flow proximate a trailing portion of the carrier fluid and propping agent mixture;

pumping into said well a displacing fluid, said displacing fluid being of a second density, said second density being less than said first density, and said ball sealers having a density in the range of from said first density to said second density;

monitoring the surface pumping pressure during pumping of the displacing fluid; and, terminating the pumping of said displacing fluid in response to detection of an increase in the surface pumping pressure of said displacing fluid.

* * * * *